US005642953A

United States Patent [19]

Kobayashi et al.

[11] Patent Number: 5,642,953

[45] Date of Patent: Jul. 1, 1997

[54] MULTIPLEX WRITING IMPLEMENT

[75] Inventors: Seiichi Kobayashi; Naoki Sekiguchi, both of Yokohama, Japan

[73] Assignee: Mitsubishi Pencil Kabushiki Kaisha, Tokyo, Japan

[21] Appl. No.: 529,585

[22] Filed: Sep. 18, 1995

Related U.S. Application Data

[62] Division of Ser. No. 328,829, Oct. 25, 1994, abandoned.

[30] Foreign Application Priority Data

| | | | |
|---|---|---|---|
| Nov. 2, 1993 | [JP] | Japan | 5-063401 U |
| Nov. 2, 1993 | [JP] | Japan | 5-063402 U |
| Apr. 22, 1994 | [JP] | Japan | 6-106273 |

[51] Int. Cl.[6] ..... B43K 27/00

[52] U.S. Cl. ..... 401/30

[58] Field of Search ..... 401/29, 30, 32, 401/52

[56] References Cited

U.S. PATENT DOCUMENTS

| | | | |
|---|---|---|---|
| 5,022,774 | 6/1991 | Kageyama et al. | 401/52 |
| 5,306,085 | 4/1994 | Kobayashi . | |

FOREIGN PATENT DOCUMENTS

| | | |
|---|---|---|
| 57-39787 | 8/1980 | Japan . |
| 58-26589 | 7/1981 | Japan . |
| 58-26577 | 8/1981 | Japan . |
| 56-125379 | 9/1981 | Japan . |
| 60-120889 | 8/1985 | Japan . |
| 60-125183 | 8/1985 | Japan . |
| 61-22683 | 2/1986 | Japan . |
| 3-79397 | 4/1991 | Japan . |
| 3-56398 | 12/1991 | Japan . |
| 6-15748 | 4/1994 | Japan . |

*Primary Examiner*—Robert A. Hafer
*Assistant Examiner*—D. Neal Muir
*Attorney, Agent, or Firm*—Darby & Darby

[57] ABSTRACT

A multiplex writing implement includes a mechanical pencil refill and ball-point pen refill which can be selectively used as desired, and is equipped with a delivering mechanism for delivering a stick-shaped article such as an eraser etc. The multiplex writing implement further includes: a front barrel for accommodating at least tip portions of these refills; a middle barrel for accommodating the remaining parts of these refills; a rear barrel which is able to rotate clockwise or counterclockwise relative to the middle barrel; and a cylindrical cam which moves integrally with the rear barrel and, in accordance with the rotational direction of the rear barrel, allows selective use of one of the refills by projecting any one of the refills from the front end of the front barrel and retracting the other refill. In this configuration, the front and middle barrels are integrally joined in such a state that each barrel is prevented from rotating and falling off relative to the other barrel.

1 Claim, 14 Drawing Sheets

MULTIPLEX WRITING IMPLEMENT

This is a division of application Ser. No. 08/328,829, filed Oct. 25, 1994 now abandoned.

BACKGROUND OF THE INVENTION (1) Field of the Invention

The present invention relates to a multiplex writing implement, and more specifically to a multiplex writing implement having at least two writing elements such as a mechanical pencil and a ball-point pen etc., which can be used selectively and further including a stick-shaped element such as an eraser etc., and a mechanism for delivering the stick-shaped element.

(2) Description of the Related Art

Various kinds of multiplex writing implements have been proposed up to now, and the basic structure for projecting and retracting a mechanical pencil refill or a ball-point pen refill as a writing element relative to the barrel body comprises a front barrel accommodating at least front end portions of the writing elements, a middle barrel accommodating the remaining portions of the writing elements, a rear barrel that is rotatable relative to the middle barrel, and a cylindrical cam which integrally moves with the rear barrel and has a shape enabling any one of the writing elements to project out of the front end of the barrel and the other writing elements to retract in accordance with the rotated direction of the rear barrel. Projection or retraction of any one of the writing elements can be performed by holding the front or middle barrel with the thumb and fingers of one hand and rotating clockwise or counter-clockwise, as required, the rear barrel with the thumb and fingers of the other hand.

The multiplex writing implement of this kind itself has a more complicated structure as compared to the single purpose writing implement consisting of a sole mechanical pencil refill or a sole ball-point pen refill. Further, in recent years, such writing implements of a complicated structure have been additionally equipped on the rear end thereof with a mechanism for delivering a stick-shaped element such as an eraser etc. For this reason, the multiplex writing implements tend to be further complicated in structure, and development of multiplex writing implements has been earnestly desired which have as simple a structure as possible and enable the storage and control of components before assembling to be further simplified.

SUMMARY OF THE INVENTION

It is therefore an object of the present invention to provide a multiplex writing implement equipped with a mechanism for delivering a stick-shaped element such as an eraser etc. and the like wherein the structure thereof is simplified and the storage and control of components before assembling are easy to perform.

In accordance with a first aspect of the present invention, a multiplex writing implement comprises: a plurality of writing elements of different types which can be selectively used as desired; a delivering mechanism which delivers a stick-shaped article such as an eraser etc.; a front barrel accommodating at least each of tip portions of the writing elements therein; a middle barrel accommodating the remaining portions of the writing elements; a rear barrel which is able to rotate clockwise or counterclockwise relative to the middle barrel; and a cylindrical cam which moves integrally with the rear barrel and, in accordance with the rotational direction of the rear barrel, pushes forward one of the writing elements so as to project the tip portion of the pushed writing element from the front end of the front barrel and retracts the tip portion of the other writing element inside the barrel and is constructed such that the front barrel and the middle barrel are integrally joined in such a state that each barrel is prevented from rotating and falling off relative to the other barrel.

In accordance with a second aspect of the present invention, a multiplex writing implement comprises: a plurality of writing elements of different types which can be selectively used as desired; a delivering mechanism which delivers a stick-shaped article such as an eraser etc.; a front barrel accommodating at least each of tip portions of the writing elements therein; a middle barrel accommodating the remaining portions of the writing elements; a rear barrel which is able to rotate clockwise or counterclockwise relative to the middle barrel; and a cylindrical cam which moves integrally with the rear barrel and in accordance with the rotational direction of the rear barrel, pushes forward one of the writing elements so as to project the tip portion of the pushed writing element from the front end of the front barrel and retracts the tip portion of the other writing element inside the barrel, and is constructed such that the rear barrel and the cylindrical cam are integrally formed.

In accordance with a third aspect of the present invention, a multiplex writing implement comprises: a plurality of writing elements of different types which can be selectively used as desired; a delivering mechanism which delivers a stick-shaped article such as an eraser etc.; a front barrel accommodating at least each of tip portions of the writing elements therein; a middle barrel accommodating the remaining portions of the writing elements; a rear barrel which is able to rotate clockwise or counterclockwise relative to the middle barrel; and a cylindrical cam which moves integrally with the rear barrel and, in accordance with the rotational direction of the rear barrel, pushes forward one of the writing elements so as to project the tip portion of the pushed writing element from the front end of the front barrel and retracts the tip portion of the other writing element inside the barrel, and is constructed such that the front barrel and the middle barrel are integrally joined in such a state that each barrel is prevented from rotating and falling off relative to the other barrel and the rear barrel and the cylindrical cam are integrally formed.

In accordance with a fourth aspect of the present invention, a multiplex writing implement comprises: a plurality of writing elements of different types; a writing element selecting mechanism for selecting, as desired, one writing element from the plurality of writing elements; and a delivering mechanism which delivers a stick-shaped article such as an eraser etc., wherein the writing element selecting mechanism comprises: a front barrel accommodating at least each of tip portions of the writing elements therein; a middle barrel disposed in the rear of the front barrel and integrally joined to the front barrel in such a state that each barrel is prevented from rotating and falling off relative to the other barrel and accommodating the remaining portions of the writing elements; a hollowed rear barrel which is disposed in the rear of the middle barrel and is able to rotate clockwise or counterclockwise relative to the middle barrel; a cylindrical cam which is integrated with the rear barrel and internally fitted inside the hollowed space of the rear barrel with a definite portion thereof being spaced from the rear barrel, is rotatable but fixed in the axial direction relative to the middle barrel and which, in accordance with the rotational direction of the rear barrel, pushes forward one of the writing elements so as to project the tip portion of the pushed writing element from the front end of the front barrel and retracts the tip portion of the other writing element inside the barrel and is formed with a pair of slits extending in the axial direction in the definite portion, and the delivering mechanism for delivering a stick-shaped article such as an eraser etc., comprises: a crown which is fitted rotatably between the rear barrel and the definite portion of the cylindrical cam, and formed with a screw groove on the inside peripheral surface thereof; and a stick-shaped article holder which is accommodated in the crown, and removably holds the stick-shaped article such as an eraser etc. and has screw-projections being engaged with the screw groove with the pair of slits being placed between the crown and the stick-shaped article holder.

In accordance with a fifth aspect of the present invention, a multiplex writing implement comprises: a plurality of writing elements of different types; a writing element selecting mechanism for selecting, as desired, one writing element from the plurality of writing elements; and a delivering mechanism which delivers a stick-shaped article such as an eraser etc., wherein the writing element selecting mechanism comprises: a front barrel accommodating at least each of tip portions of the writing elements therein; a middle barrel disposed in the rear of the front barrel and integrally joined to the front barrel in such a state that each barrel is prevented from rotating and falling off relative to the other barrel and accommodating the remaining portions of the writing elements; a rear barrel which is disposed in the rear of the middle barrel, and is able to rotate clockwise or counterclockwise relative to the middle barrel, has a hollowed space thereinside and has a screw groove formed on the inside wall defining the hollowed space; a cylindrical cam which is integrated or integrally formed with the rear barrel and is rotatable but fixed in the axial direction relative to the middle barrel, and in accordance with the rotational direction of the rear barrel, pushes forward one of the writing elements so as to project the tip portion of the pushed writing element from the front end of the front barrel and retracts the tip portion of the other writing element inside the barrel, and the delivering mechanism for delivering a stick-shaped article such as an eraser etc., comprises: a crown which comprises an externally fitted portion on the rear barrel and an internally fitted portion inside the rear barrel and is attached rotatably to the rear barrel, wherein the internally fitted portion is formed with a pair of slits extending in the axial direction thereof; and a stick-shaped article holder which is accommodated in the crown, removably holds the stick-shaped article such as an eraser etc. and has screw-projections being engaged with the screw groove of the rear barrel with the pair of slits being placed between the rear barrel and the stick-shaped article holder.

In accordance with a sixth aspect of the present invention, a multiplex writing implement comprises: a plurality of writing elements of different types; a writing element selecting mechanism for selecting, as desired, one writing element from the plurality of writing elements; and a delivering mechanism which delivers a stick-shaped article, wherein the writing element selecting mechanism comprises: a front barrel accommodating at least each of tip portions of the writing elements therein; a middle barrel disposed in the rear of the front barrel and integrally joined to the front barrel in such a state that each barrel is prevented from rotating and falling off relative to the other barrel and accommodating the remaining portions of the writing elements; and a cylindrical cam comprising: a rear barrel which is disposed in the rear of the middle barrel, and is able to rotate clockwise or counterclockwise relative to the middle barrel and has a screw groove on the inside wall thereof; and a cam portion which is integrated or integrally formed with the rear barrel, is accommodated inside the middle barrel, and is rotatable but fixed in the axial direction relative to the middle barrel, and in accordance with the rotational direction of the rear barrel, pushes forward one of the writing elements so as to project the tip portion of the pushed writing element from the front end of the front barrel and retracts the tip portion of the other writing element inside the barrel, and the delivering mechanism for delivering a stick-shaped article comprises: a crown which comprises an externally fitted portion on the rear barrel and an internally fitted portion inside the rear barrel and is attached rotatable to the rear barrel, the internally fitted portion being formed with a pair of slits extending in the axial direction thereof; and a stick-shaped article holder which is accommodated in the crown, removably holds the stick-shaped article and has screw-projections being engaged with the screw groove of the rear barrel with the pair of slits being placed between the rear barrel and the stick-shaped article holder.

In accordance with a seventh aspect of the present invention, a multiplex writing implement comprises: a plurality of writing elements of different types; a writing element selecting mechanism for selecting, as desired, one writing element from the plurality of writing elements; and a delivering mechanism which delivers a stick-shaped article such as an eraser etc., wherein the writing element selecting mechanism comprises: a front barrel accommodating at least each of tip portions of the writing elements therein; a middle barrel disposed in the rear of the front barrel and integrally joined to the front barrel in such a state that each barrel is prevented from rotating and falling off relative to the other barrel and accommodating the remaining portions of the writing elements; a rear barrel which is disposed in the rear of the middle barrel, is able to rotate clockwise or counterclockwise relative to the middle barrel, is fixed in the axial direction, and has a hollowed space thereinside; and a cylindrical cam which is fitted inside the hollowed space of the rear barrel and spaced from the inside wall of the rear barrel, is slidable in the axial direction, has a pair of slits extending in the axial direction, and in accordance with the rotational direction of the rear barrel, pushes forward one of the writing elements so as to project the tip portion of the pushed writing element from the front end of the front barrel and retracts the tip portion of the other writing element inside the barrel, and the delivering mechanism for delivering a stick-shaped article such as an eraser etc., comprises: a crown which is rotatably fitted between the rear barrel and the cylindrical cam, has a screw groove formed on the inside peripheral surface thereof and is integrally engaged with the cylindrical cam; and a stick-shaped article holder which is accommodated in the crown removably holds the stick-shaped article such as an eraser etc., and has screw-projections being engaged with the screw groove with the pair of slits being placed between the crown and the stick-shaped article holder.

Accordingly, in accordance with the present invention, since the front barrel and the middle barrel are joined integrally in such a state that each element is prevented from rotating and falling off relative to the other element, the front barrel and the middle barrel may be integrated.

Further, in accordance with the present invention, since the rear barrel and the cylindrical cam are integrally formed, the rear barrel and the cylindrical cam may be controlled in common.

BRIEF DESCRIPTION OF THE DRAWINGS

The above and other objects and novel features of the present invention will be more fully understood from the following detailed description in conjunction with the accompanying drawings. However, these drawings are provided for the purpose of illustration only and not limitation. In the drawings:

FIG. 2 shows a state where the multiplex writing implement of the invention is used as a mechanical pencil while FIG. 3 shows a state where the multiplex writing implement of the invention is used as a ball-point pen;

DESCRIPTION OF THE PREFERRED EMBODIMENTS

Figure 1:
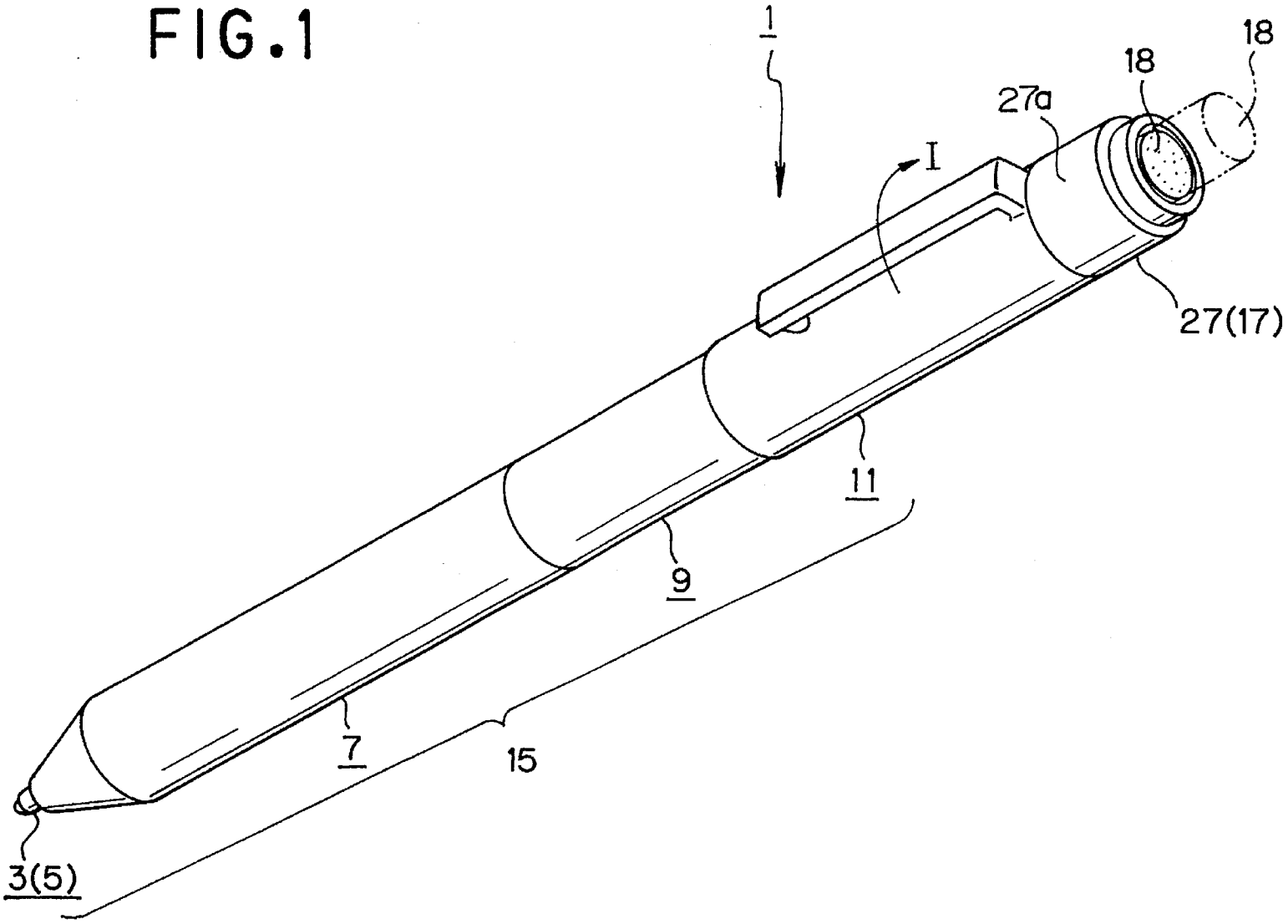
FIG. 1 is an overall perspective view showing a preferred embodiment of a multiplex writing implement in accordance with the present invention.

A multiplex writing implement 1 basically comprises the following four components 1) to 4). That is, the multiplex writing implement 1 includes:

1) a mechanical pencil refill 3 and a ball-point pen refill 5 as writing elements;

2) a writing implement mechanism 14 which enables selective use of the mechanical pencil refill 3 and the ball-point pen refill 5, comprising: a front barrel 7 for accommodating at least tip portions 3*a* and 5*a* of these refills 3 and 5 and allowing the tips of the refills 3 and 5 to project; a middle barrel 9 positioned at the rear of the front barrel 7 for accommodating the remaining parts 3*b* and 5*b* of the mechanical pencil refill 3 and the ball-point pen refill 5; a rear barrel 11 positioned at the rear of the middle barrel 9 and being rotatable relative to the middle barrel 9; and a cylindrical cam 13 being rotatable integrally with the rear barrel 11 in accordance with the rotational direction of the rear barrel 11, thereby allowing selective use of the mechanical pen refill 3 and the ballpoint pen refill 5 by projecting any one of the refills 3 and 5 from the front end of the front barrel 7 and retracting the other refill;

3) an eraser delivering mechanism 17 including a crown 27 being accommodated inside the rear barrel 11 with a part thereof being projected and an eraser holder 29 accommodated inside the crown 27 and detachably holding a stick-shaped eraser 18; and 4) the stick-shaped eraser 18.

These components will hereinafter be described by turns, but since the mechanical pencil refill 3 and the ball-point pen refill 5 as writing implements mentioned in 1) and the stick-shaped eraser 18 mentioned in 4) are well known, these items are only shown in the drawings, except the case where particular description is required.

Figure 4:
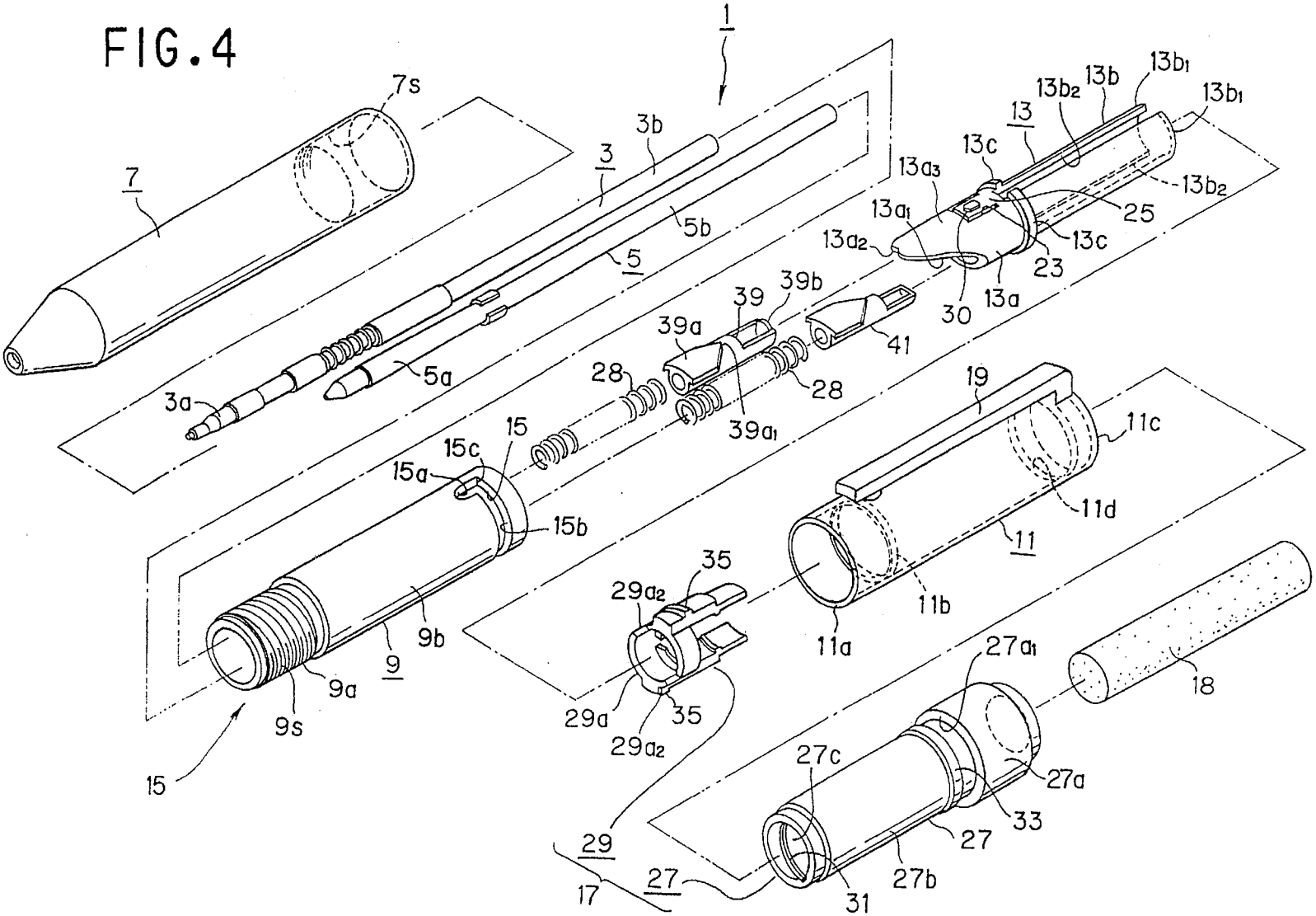
FIG. 4 is a perspective exploded view of FIG. 1.
Figure 5:
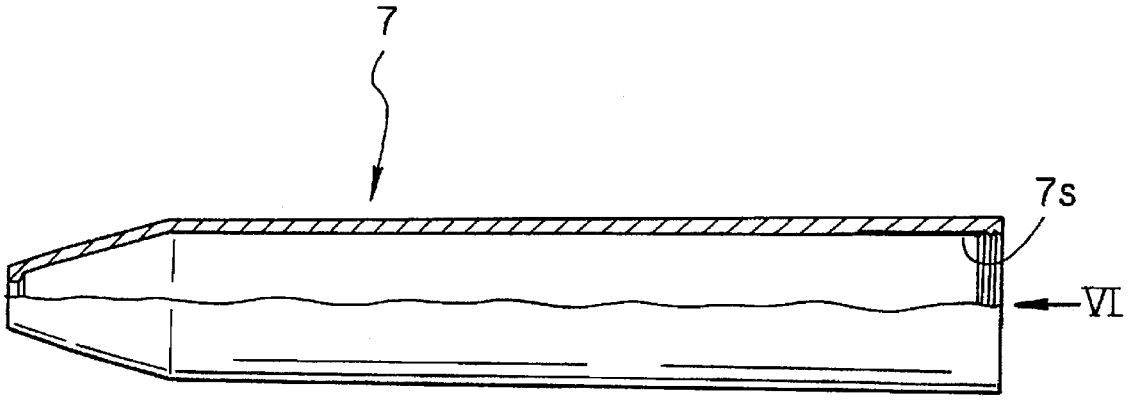
FIG. 5 is a partially cut-away view showing a front barrel as a component of the multiplex writing implement of the present invention.
Figure 6:
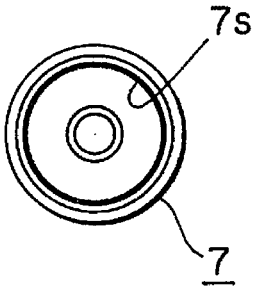
FIG. 6 is a view taken from a direction indicated by arrow VI in FIG. 5.
Figure 7:
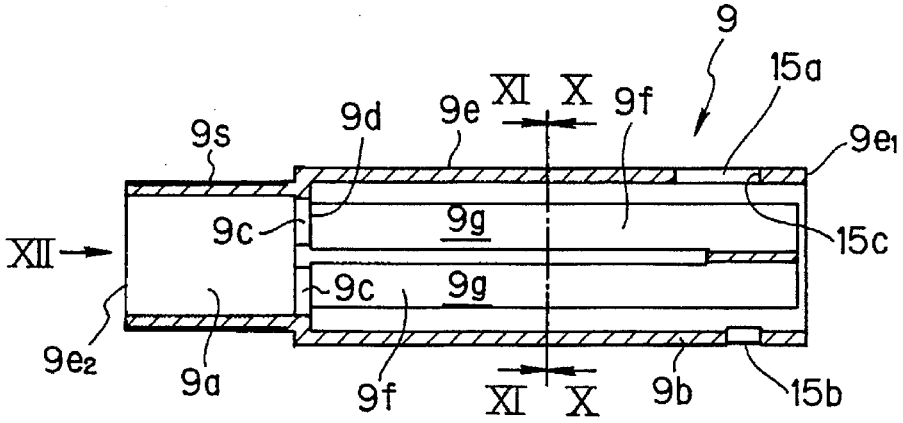
FIG. 7 is a longitudinal sectional view of a middle barrel as a component of the multiplex writing implement of the present invention.
Figure 8:
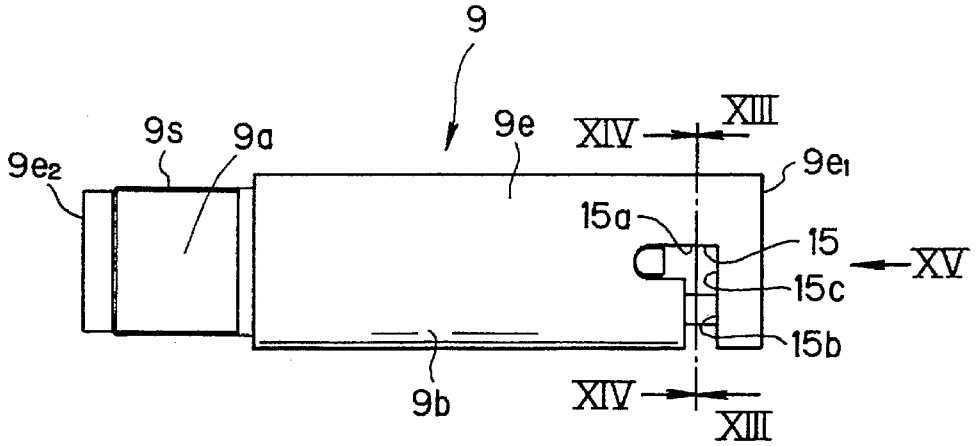
FIG. 8 is a plan view of the middle barrel.
Figure 9:
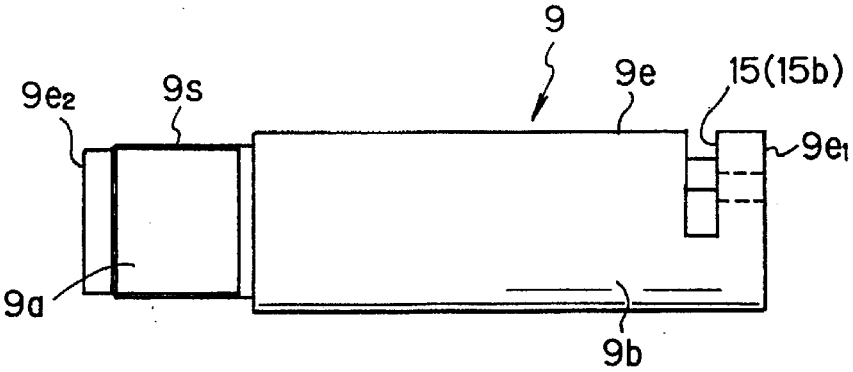
FIG. 9 is a bottom view of the middle barrel.
Figure 10:
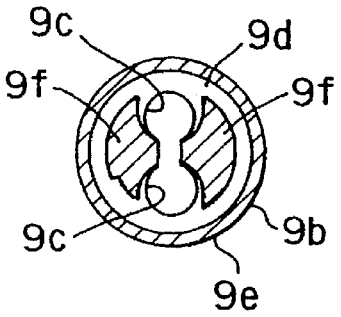
FIG. 10 is a transverse cross sectional view of FIG. 7, taken along line X—X and viewed from a direction shown by the corresponding arrow.
Figure 11:
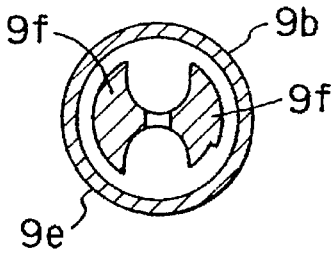
FIG. 11 is a transverse cross sectional view of FIG. 7, taken along line XI—XI and viewed from a direction shown by the corresponding arrow.
Figure 12:
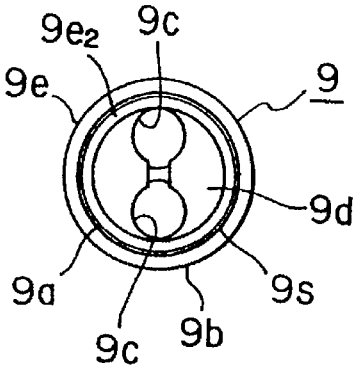
FIG. 12 is a view taken from a direction indicated by arrow XII in FIG. 7.
Figure 13:
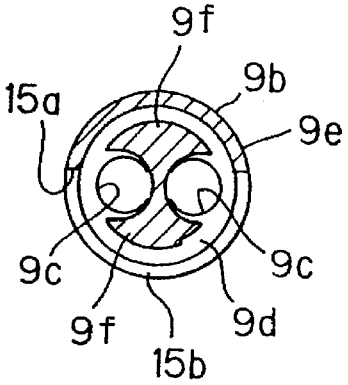
FIG. 13 is a transverse cross sectional view of FIG. 8, taken along line XIII—XIII and viewed from a direction shown by the corresponding arrow.
Figure 14:
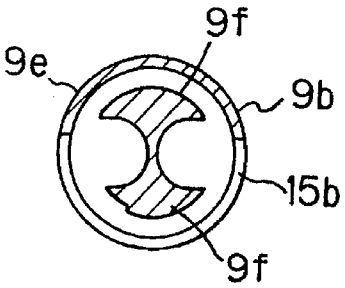
FIG. 14 is a transverse cross sectional view of FIG. 8, taken along line XIV—XIV and viewed from a direction shown by the corresponding arrow.
Figure 15:
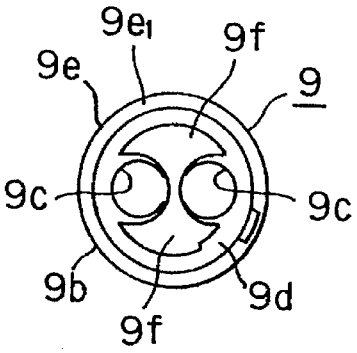
FIG. 15 is a view taken from a direction indicated by arrow XV in FIG. 8.

The front barrel 7 is a cylindrical casing with a truncated conical shape at the front end thereof as shown in FIGS. 1, 4 and 5. The inside peripheral surface in the rear portion of the front barrel 7 is formed with a female screw 7*s* as illustrated in FIGS. 4 to 6. The female screw 7*s* mates with a male screw 9*s* of the middle barrel which will be detailed next and is to integrally join the front barrel 7 with the middle barrel 9 tightly in such a state that each element is prevented from rotating and falling off relative to the other element. The truncated conical shape at the front end of the front barrel 7 is formed so as to fixedly catch the tip portion 3*a* or 5*a* of each refill for allowing easy handling when the mechanical pencil refill 3 or the ball-point pen refill 5 is projected from the front end.

The middle barrel 9 is a cylindrical body which, with both ends opened, has a small diameter portion 9*a* in the front portion thereof and a large diameter portion 9*b* extended in the rear of the front portion, as shown in FIGS. 4, and 7 through 9. Provided at the boundary between the small diameter portion 9*a* and the large diameter portion 9*b* is a partitioning wall 9*d* formed with through-holes 9*c*, 9*c* arranged in series in diameter direction of the middle barrel 9 as understood from FIGS. 2, 3, 7, 10, 12, 13, and 15.

The outside peripheral surface of the small diameter portion 9*a* is formed with the male screw 9*s* which is mated with the aforementioned female screw 7*s* of the front barrel 7 for integrally uniting the front barrel 7 with the middle barrel 9.

The large diameter portion 9*b* is, as shown in FIGS. 7 through 15, composed of a cylindrical peripheral wall 9*e* and partitioning walls 9*f*, 9*f* axially extending thereinside.

The cylindrical peripheral wall 9*e* is formed in the rear end portion thereof with a cutout 15 which has an L-shape when it is formed. The cutout 15 is to receive an engaging projection of the cylindrical cam 13 to be referred to later and is composed of an axially extending portion 15*a* extending along the axis from a site slightly spaced from a rear edge $9e_1$ of the peripheral wall 9*e* toward the side of a front edge $9e_2$ and a circumferentially extending portion 15*b* extending substantially semicircularly from the site on the side of the rear edge $9e_1$ of the cylindrical peripheral wall 9*e* along the circumferential direction of the cylindrical peripheral wall 9*e*. The site where the axially extending portion 15*a* meets the circumferentially extending portion 15*b* will be called a crossing point 15*c* (refer to FIGS. 4, 7 and 8).

The axially extending portion 15*a* is a part which is needed for delivering a lead when the mechanical pencil refill 3 is knocked and moved forward and backward in the axial direction. On the other hand, the circumferentially extending portion 15*b* is a part which is needed for making a desired selection of the mechanical pencil refill 3 and the ball-point pen refill 5. The axially extending portion 15*a* has enough length necessary to deliver the lead by one knocking when the writing implement 1 is used as a mechanical pencil. The length of the circumferentially extending portion 15*b* may be long enough as far as the change is allowed from the mechanical pencil to the ballpoint pen or vice versa, and nothing is limited by the above reference that the portion 15*b* extends substantially semicircularly in the circumferential direction. The partitioning walls 9*f*, 9*f* are constructed such that a transverse cross section of a pair of gingko leaves (fan-shaped leaves) being arranged with their petioles put together as illustrated in FIGS. 10, 11, and 13 through 15, is elongated in the axial direction. Accordingly, a pair of guiding passages 9*g*, 9*g* being elongated axially and having a transverse cross section of a pair of semicircles are defined between the partitioning walls 9*f*, 9*f*, as apparent from FIGS. 2, 3 and 7. These guiding passages 9*g*, 9*g* communicate coaxially with respective through-holes 9*c*, 9*c* in the aforementioned partitioning wall 9*d*, and accommodate sliders 39, 41 (to be detailed hereinbelow) which are attached to the rear ends of the mechanical pencil refill 3 and ball-point pen refill 5, respectively.

Figure 2:
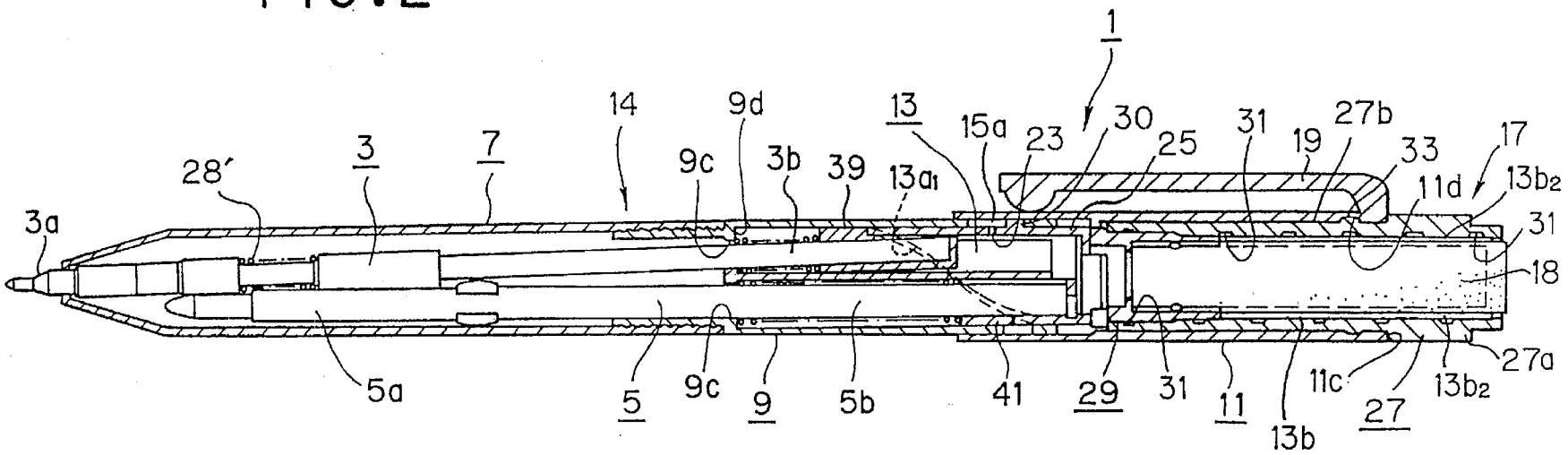
FIGS. 2 and 3 are longitudinal sectional views of FIG. 1 for showing an inside structure of the multiplex writing implement in accordance with the present invention, specifically.
Figure 3:
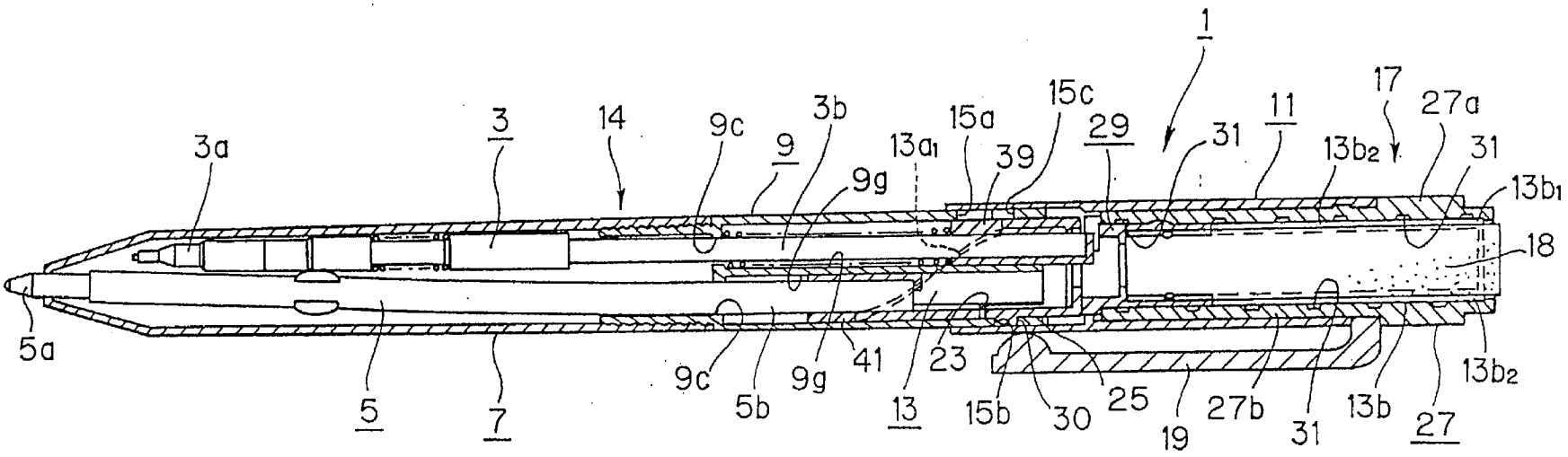
Figure 16:
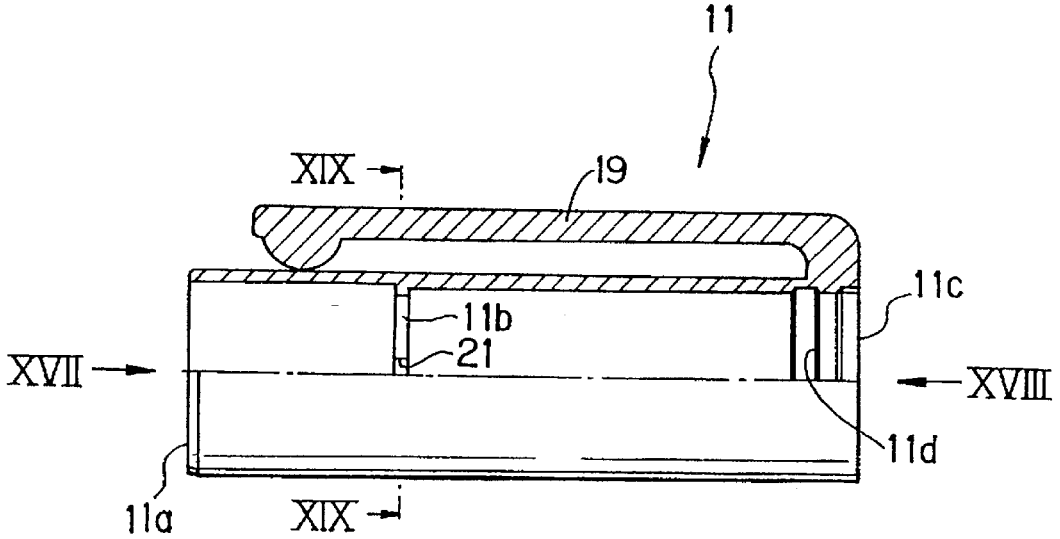
FIG. 16 is a longitudinal sectional view showing a rear barrel as a component of the multiplex writing implement in accordance with the present invention.
Figure 17:
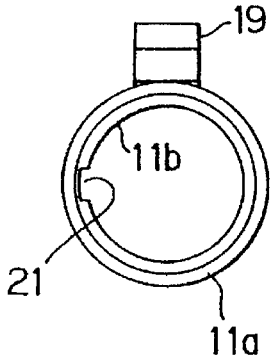
FIG. 17 is a view taken from a direction indicated by arrow XVII in FIG. 16.
Figure 18:
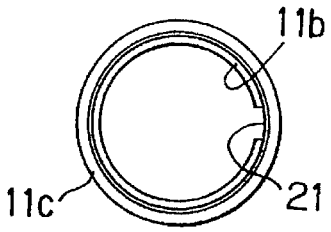
FIG. 18 is a view taken from a direction indicated by arrow XVIII in FIG. 16.
Figure 19:
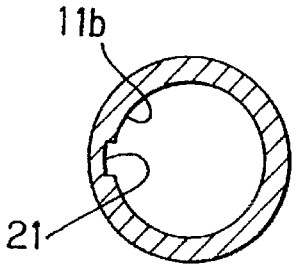
FIG. 19 is a transverse cross sectional view of FIG. 16, taken along line XIX—XIX and viewed from a direction shown by the corresponding arrow.
Figure 20:
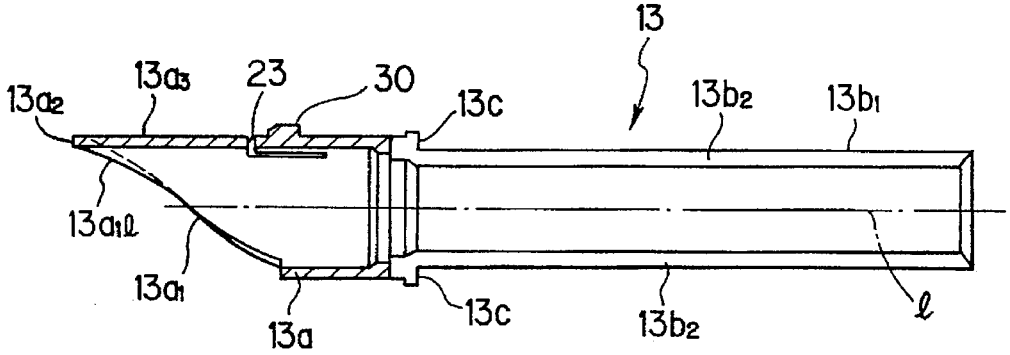
FIG. 20 is a longitudinal sectional view showing a cylindrical cam as a component of the multiplex writing implement in accordance with the present invention.
Figure 21:
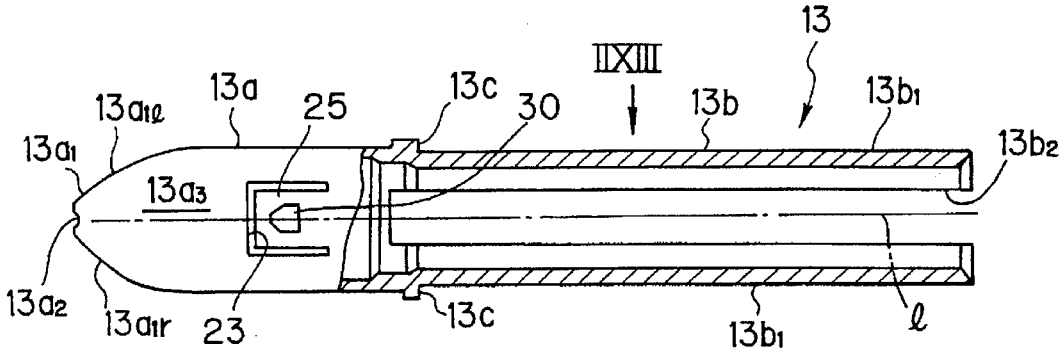
FIG. 21 is a plan view showing a cylindrical cam.
Figure 22:
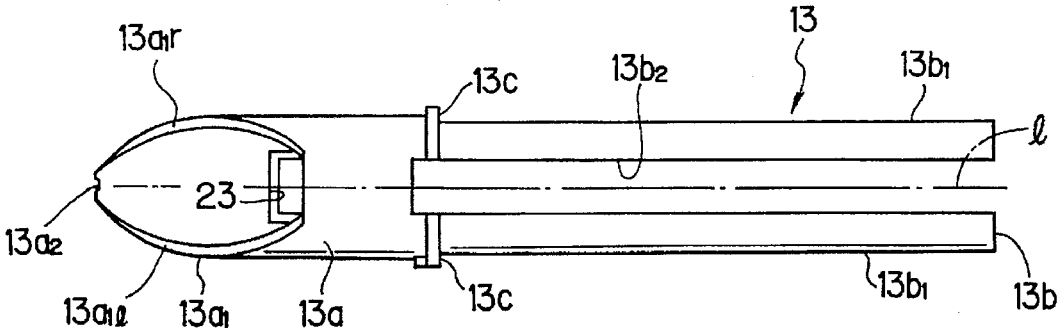
FIG. 22 is a bottom view of the cylindrical cam.
Figure 23:
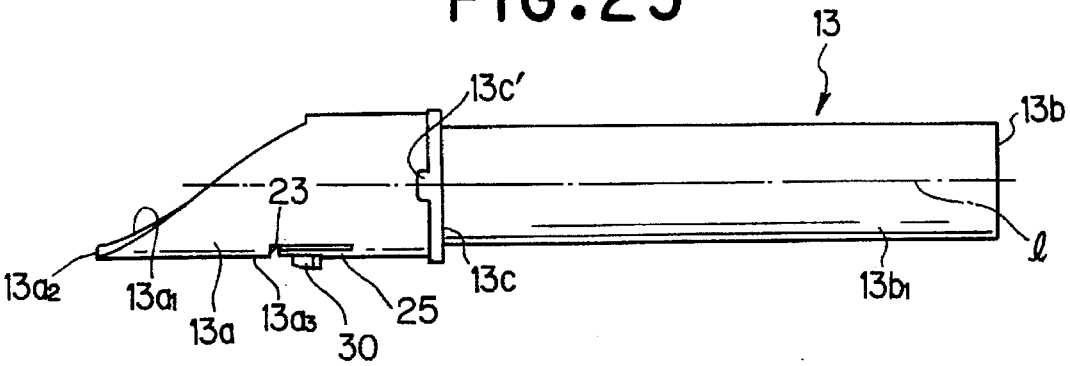
FIG. 23 is a view taken from a direction indicated by arrow IIXIII in FIG. 21.
Figure 24:
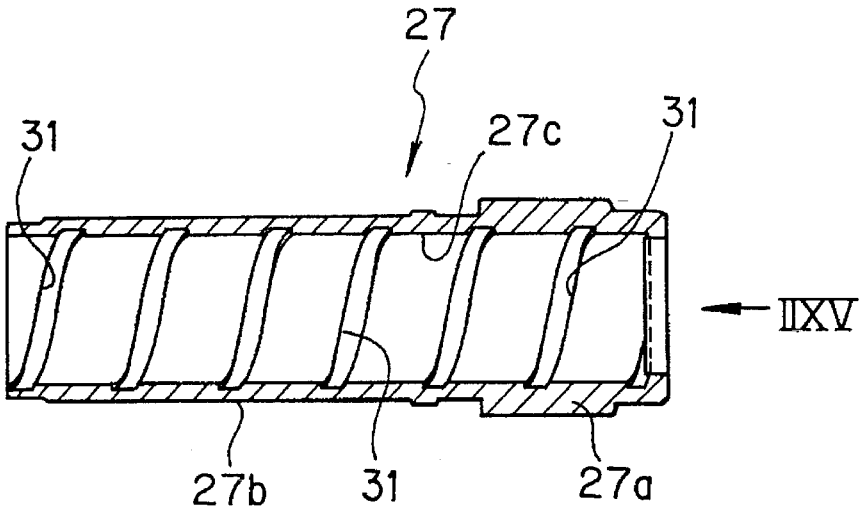
FIG. 24 is a longitudinal sectional view showing a crown as a component of the multiplex writing implement in accordance with the present invention.
Figure 25:
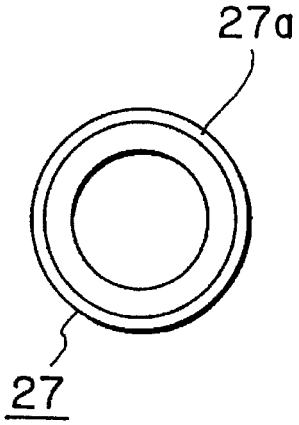
FIG. 25 is a view taken from a direction indicated by arrow IIXV in FIG. 24.
Figure 26:
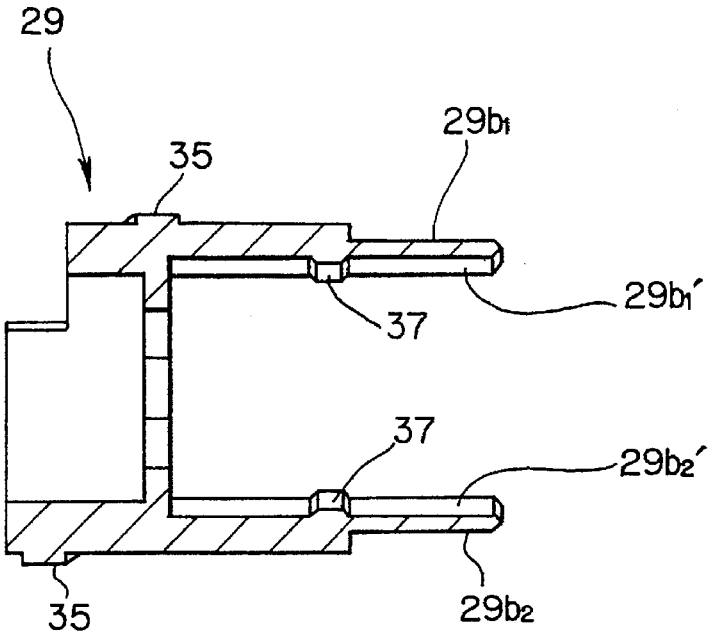
FIG. 26 is a longitudinal sectional view showing a holder for a stick-shaped element such as an eraser etc. as a component of the multiplex writing implement in accordance with the present invention.
Figure 27:
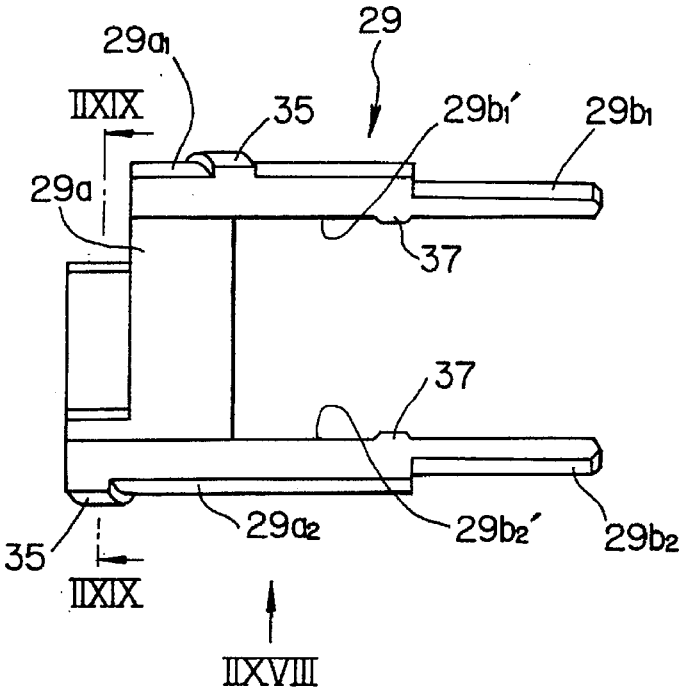
FIG. 27 is a side view of the holder for a stick-shaped element such as an eraser etc. as a component of the multiplex writing implement in accordance with the present invention.
Figure 28:
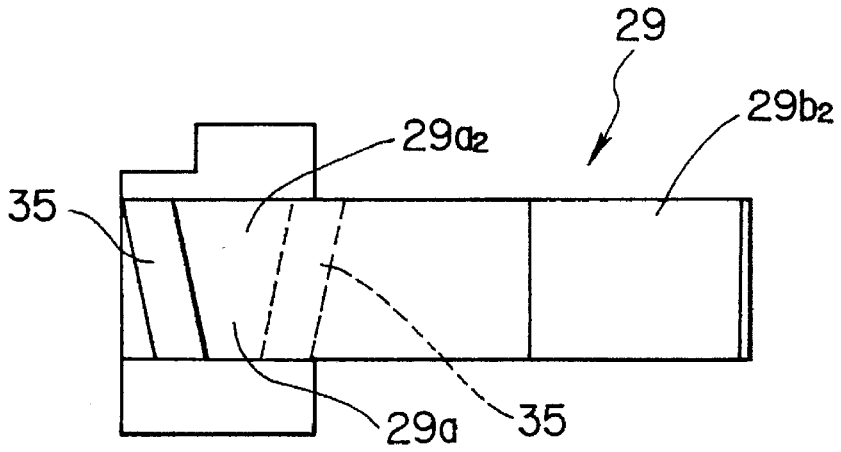
FIG. 28 is a view taken from a direction indicated by arrow IIXVIII in FIG. 27.

The rear barrel 11 is, as understood from FIGS. 2 and 3, a cylindrical member with both ends opened and accommodates a cylindrical cam 13, an eraser delivering mechanism 17 and a stick-shaped eraser 18. A clip 19 allowing the writing implement 1 to be attached to clothes etc., is integrally formed on the outside peripheral of the rear barrel 11. Further, as is understood from FIGS. 2, and 16 through 19, an annular rib 11*b* with a recess 21 partly cut out is formed inside the rear barrel 11, at a site in the center rather closer to a front edge 11*a* of the rear barrel 11. The cutout recess 21 is mated with an after-mentioned engaging projection formed in the cylindrical cam 13. Provided at a site close to a rear edge 11*c* on the inside peripheral surface of the rear barrel 11 is, as shown in FIG. 16, an annular angled groove 11*d* which is engaged with an after-mentioned annular angled flange 33 formed on the crown 27 as a component of the eraser delivering mechanism 17.

As illustrated in FIGS. 4, and 20 through 23, the cylindrical cam 13 is a hollowed rod-like member composed of a cam portion 13*a*, a pair of extensions 13*b* forked from the rear of the cam portion 13*a* and a pair of semicircular flanges 13*c*, 13*c* arranged between the cam portions 13*a* and the extensions 13*b*.

The cam portion 13*a* is constructed such that, when the cylindrical cam 13 is rotated integrally with the rear barrel 11 as stated above, a cam surface $13a_1$ of the cam portion 13*a* selectively pushes out one of the sliders 39 and 41 and draws in the other, to thereby project one of the mechanical pencil refill 3 and ball-point pen refill 5. More specifically, the cam portion 13*a* is constructed such that a front part of a hollowed cylinder is truncated slantly in a wavy curve, forming a shape similar to a nib of a fountain pen.

The cam surface $13a_1$ has two symmetrical surfaces $13a_{1r}$, and $13a_{1l}$ on right and left sides, respectively, with respect to a center line 1 thereof. The right and left sides referred to here are defined by the positions when the side of the clip 19 is fronted with the pen tip of the writing implement 1 downed. The aforementioned sliders 39, 41 of the mechanical pencil refill 3 and ball-point pen refill 5 are abutted elastically at all times against the left and right surfaces $13a_{1l}$ and $13a_{1r}$, respectively by virtue of appropriate elastic members 28, 28 illustrated in FIG. 4 etc.

When any one of sliders with refills occupies at a top 13*a*, of the cam portion 13*a*, the corresponding refill is projected from the front end of the front barrel 7. On the other hand, when no slider with refill occupies at the top $13a_2$, neither refill 3 or 5 projects out, or in other words, both-the refills 3 and 5 are accommodated inside the writing implement 1. In the non-projected state, an after-mentioned engaging projection 30 which is engaged with the L-shaped cutout 15 is positioned at any site along the circumferentially extending portion 15*b*.

Provided on an upper wall $13a_3$ of the cam portion 13*a* is a cutout groove 23 in the form of a one-side opened box shape or a U-shape. This cutout groove 23 defines a rectangular region 25, which engages the aforementioned L-shaped cutout 15. An engaging projection 30 is formed in the region 25 in order to prevent the engagement of the cylindrical cam 13 from drawing out from the middle barrel 9 at least during the cylindrical cam 13 is rotated relative to the middle barrel 9.

The extensions 13*b* as parts of the cylindrical cam 13 have such a structure that a central part containing the center axis is cut out from a hollowed cylinder. In other words, the extensions 13*b* are arranged such that a pair of hollowed semicylindrical portions $13b_1$, $13b_1$ are vertically arranged with their bottoms faced with one another keeping a space therebetween in order to form slits $13b_2$, $13b_2$. The clearance of the slit $13b_2$ has a dimension as large as allowing after-mentioned partial-screw projections 35 of the eraser holder 29 to be projected therefrom.

The thus constructed cylindrical cam 13, as being inserted into the crown 27, is accommodated inside the rear barrel 11. Further, the extensions 13*b* loosely hold the stick-shaped eraser 18 which is delivered by the eraser delivering mechanism 17.

The semicircular flanges 13*c*, 13*c* serve as stoppers which, when the extensions 13*b* are fitted into the crown 27 as stated above, prevent the extensions 13*b* from being inserted more that they need. Besides, one of the semicircular flanges 13*c*, 13*c* (the left one in this embodiment) has a projection 13*c*' formed for meshing with the cutout recess 21 formed on the rib 11*b* of the rear barrel 11. The engagement between the recess 21 and projection 13*c*' integrates the rear barrel 11 with the cylindrical cam 13, therefore the cylindrical cam 13 may rotate as the rear barrel 11 is rotated.

The crown 27 is a cylindrical member with both ends opened which is composed of a rear portion 27*a* and a front portion 27*b* with the former portion having a larger diameter to some degree than the latter portion. A right-handed screw groove 31 is formed on an inside peripheral surface 27*c* of the crown 27 entirely across the front end to the rear end.

The rear portion 27*a* is a part projected rearward from the rear barrel 11 when the front portion 27*b* of the crown 27 is inserted into the rear barrel 11, whereby the user can hold the rear portion 27*a* and rotate it clockwise or counterclockwise. Further, the rear portion 27*a* also serves as a knocked portion when the multiplex writing implement 1 is used as a mechanical pencil. In knocking, a front edge $27a_1$ of the rear portion 27*a* abuts the rear edge 11*c* of the rear barrel 11 since the rear portion 27*a* is greater in diameter than the front portion 27*b*. As a result, both the crown 27 and the rear barrel 11 move together in the axial direction when the crown is knocked.

The aforementioned annular angled flange 33 is formed, as shown in FIG. 4, on the front portion 27*b* inserted into the rear barrel 11, in a site closer to the rear portion 27*a*. The annular angled flange 33 is a mating portion with the annular angled groove 11*d* of the rear barrel 11. This engagement prevents the crown 27 from falling off the rear barrel 11 and allows the crown 27 to be freely rotated clockwise or counterclockwise relative to the rear barrel 11.

Figure 29:
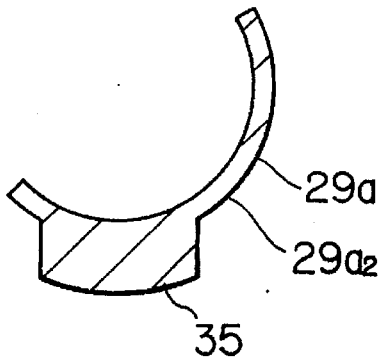
FIG. 29 is a transverse cross sectional view of FIG. 27, taken along line IIXIX—IIXIX and viewed from a direction shown by the corresponding arrow.

The eraser holder 29 is formed such that a stepped pipe of different diameter portions is partially cut out as illustrated FIGS. 4, and 26 through 29. Specifically, the eraser holder 29 comprises: a base portion 29*a* made up of a pipe consisting of a cutout side $29a_1$ and a non-cutout side $29a_2$; and a pair of screw fitting portions $29b_1$ and $29b_2$. Here, the base portion 29*a* is shaped such that a front part of the pipe ranging more than 180 degrees is cut out from the pipe of the eraser holder 29 in the longitudinal direction from the front edge to the middle of eraser holder 29, thereby forming the cutout side $29a_1$ and the non-cutout side $29a_2$ as shown in FIGS. 4 and 29. On the other hand, screw fitting portions $29b_1$ and $29b_2$ form forked parts extended rearward from respective parts of the cutout side $29a_1$ and the non-cutout side $29a_2$. Further, each of the screw fitting portions $29b_1$ and $29b_2$ has a partial screw-projection 35 formed partly on an outside peripheral surface thereof. These partial screw projections 35 are engaged with the screw groove 31 on the crown 27. A pair of eraser catches 37, 37 allowing the stick-shaped eraser 18 to be attached and removed are formed on the inside surfaces $29b_1$' and $29b_2$' of the screw fitting portions $29b_1$ and $29b_2$, respectively. As a result, when the thus constructed eraser holder 29 is fitted into the crown 27, the partial screw-projections 35, 35 are engaged with the screw groove 31 with the pair slits $13b_2$, $13b_2$ placed therebetween.

The sliders 39, 41 are attached to the rear ends of the mechanical pencil refill 3 and the ball-point pen refill 5, respectively. The shapes of the sliders 39, 41 are well known and have substantially similar features, so that description will be made on only the slider 39.

The slider 39 is composed of a slider projection 39*a* in a form of a shield-shape having an angled tip and a cylindrical base portion 39*b* which is integrally formed with the slider projection 39*a* and is fitted externally on the rear end 3*b*' of the refill 3. The angled tip $39a_1$ of the slider projection 39*a* is to elastically abut at all times against the cam surface $13a_1$ of the cam portion 13*a* as stated before.

Next, the usage of the thus constructed multiplex writing implement 1 will be described. At the beginning of the description, it is assumed that the operation of the writing implement 1 is started from an initial state in which any one of the refills 3, 5 does not project at all from the front barrel 7, alternatively, any one of the refills does not project completely. Accordingly, in this state, the sliders 39 and 41 attached to respective rear ends of the mechanical pencil refill 3 and the ball-point pen refill 5 are abutted against the left cam surface $13a_{1l}$, and the right cam surface $13a_{1r}$, of the cam surface $13a_1$ of the cylindrical cam 13, respectively. In other words, neither of the sliders is positioned at the top $13a_2$ of the cam portion 13*a* of the cylindrical cam 13.

Initially, in the case where the multiplex writing implement 1 is used as a mechanical pencil, the operator picks the rear barrel 11 with his or her right-hand thumb and forefinger and picks the front or middle barrel with his or her left-hand thumb and forefinger in a similar manner. Subsequently, the operator rotates the rear barrel 11 clockwise (in the direction indicated by arrow I in FIG. 1) with the right hand. By this operation, the cylindrical cam 13 is rotated clockwise since the cylindrical cam 13 is integrated with the rear barrel 11 by the engagement between the recess 21 of the rear barrel 11 and the projection 13*c*' of the cylindrical cam 13. The engaging projection 30 of the cylindrical cam 13 which is engaged with the L-shaped cutout 15 is thereby positioned at any site along the circumferentially extending portion 15*b* other than the crossing point 15*c*. Then, the engaging projection 30 of the cylindrical cam 13 is moved by the clockwise force acted on the rear barrel 11 from the right to the left along the circumferentially extending portion 15*b* reaching the crossing point 15*c*. Simultaneously, the mechanical pencil refill 3 positioned on the side of the left cam surface $13a_{1l}$, of the cam surface $13a_1$ of the cylindrical cam 13, is pushed forward through its slider 39 by the left cam surface $13a_{1l}$. When the slider 39 reaches the top $13a_2$ of the cam portion 13*a* the tip portion 3*a* of the mechanical pencil refill 3 is projected from the front end of the front barrel 7. Thus, the writing implement 1 is prepared as a mechanical pencil.

In this state, when the operator knocks the rear end of the crown 27, the front edge $27a_1$ of the rear portion 27*a* of the crown 27 which abuts the rear edge 11*c* of the rear barrel 11, pushes the rear barrel 11 forward in the axial direction. Simultaneously, the urging force is transmitted to the cylindrical cam 13 by way of the eraser holder 29, and the engaging projection 30 of the cylindrical cam 13 is made to move forward in the axial direction from the crossing point 15*c* of the L-shaped cutout 15. This movement is transmitted to the mechanical pencil refill 3 since the top $13a_2$ of the cylindrical cam 13 is abutted against the mechanical pencil refill 3 via the slider 39. As a result, an unillustrated chuck inside the refill 3 is released from an unillustrated chuck ring to deliver a proper length of a lead. Then, as the knock ends, the chuck retracts to be engaged with the chuck ring so that the chuck clamps the lead to allow writing. In order that another knock can be imparted as soon as a prior knock ends, an elastic member 28' is provided in the front part of the refill 3, whereby the engaging projection 30 of the cylindrical cam 13 moves back from the axially front end of the axially extending portion 15*a* of the L-shaped cutout 15 to the aforementioned crossing point 15*c*.

On the other hand, when the multiplex writing implement 1 having been used as a mechanical pencil, is used as a ball-point pen, the rear barrel 11 is rotated counterclockwise (in the opposite direction to that indicated by the arrow I in FIG. 1). Then, the cylindrical cam 13 which is integrated with the rear barrel 11 as stated above rotates counterclockwise. The engaging projection 30 of the cylindrical cam 13 is thereby moved from the crossing point 15*c* of the circumferentially extending portion 15*b* of the L-shaped cutout 15 up to the opposite end of the circumferentially extending portion 15*b*. Simultaneously, the slider 39, positioned at the top $13a_2$ of the cam portion 13*a* is made to move to the side of the left cam surface $13a_{1l}$ while the ball-point pen refill 5 is pushed forward through its slider 41 by the right cam surface $13a_{1r}$. When the slider 41 reaches the top $13a_2$ of the cam portion 13*a*, the tip portion 5*a* of the ball-point pen 5 is projected from the front end of the front barrel 7. Thus, the writing implement 1 is prepared as a ball-point pen.

Next, the usage of the stick-shaped eraser 18 will be described.

In this case, in the same manner as when the refill 3 or 5 is projected from the front end of the front barrel 7, the operator picks the rear portion 27*a* of the crown 27 with the right-hand thumb and forefinger and picks the front or middle barrel with the left-hand thumb and forefinger in the same manner. In this state, the aforementioned rear portion 27*a* is rotated clockwise (in the direction shown by the arrow I in FIG. 1). This rotational force causes the eraser holder 29, which has the partial screw-projections 35 engaged with the screw groove 31 of the crown 27 with the pair slits $13b_2$, $13b_2$ of the cylindrical cam 13 being placed therebetween, to rise inside the crown 27 as being guided by the slits $13b_2$, $13b_2$. Accordingly, the eraser 18 held by the eraser holder 29 moves upward so that the upper part of the eraser 18 is projected from the rear portion 27*a* of the crown 27. Thus, the eraser 18 is prepared for use. After use, by rotating the rear portion 27*a* counterclockwise, the projected eraser 18 is retracted into the crown 27.

Thus, according to the present invention, since the front barrel 7 and the middle barrel 9 are joined integrally in such a state that each element is prevented from rotating and falling off relative to the other element, the front barrel 7 and the middle barrel 9 may be integrated.

Further, in accordance with the present invention, since the rear barrel 11 and the cylindrical cam 13 are integrally formed, the rear barrel 11 and the cylindrical cam 13 may be controlled in common. Accordingly, the storage and control of the components before assembling can be eased.

Moreover, since the eraser holder 29 has the forkedly extended screw fitting portions $29b_1$ and $29b_2$, it is possible to make markedly easy the assembling of the eraser holder 29 into the crown 27 by narrowing the distal ends of the screw fitting portions $29b_1$ and $29b_2$.

Besides, since the front barrel 7 and the middle barrel 9 are joined by the screw-engagement between the female screw 7*s* inside the front barrel 7 and the male screw 9*s* on the middle barrel 9, the front barrel 7 can be freely detached from the middle barrel 9, as required. Therefore, it is possible to easily supply or replace leads for the mechanical pencil without doing a troublesome labor of removing the whole part of the delivering mechanism 17 for stick-shaped eraser at the rear end of the writing implement 1.

Figure 30:
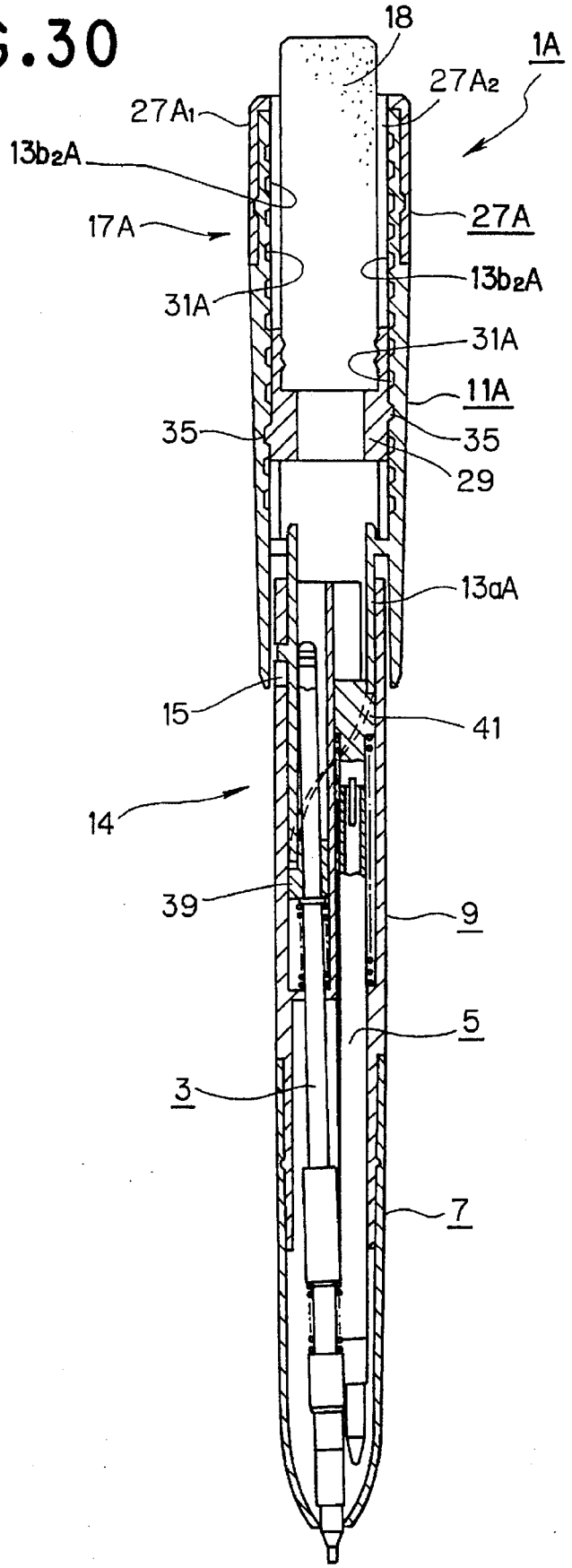
FIG. 30 is a longitudinal sectional view showing a first variational example of a multiplex writing implement in accordance with the present invention.

FIG. 30 shows a first variational example 1A of a writing implement 1. Since only the rear barrel, the cylindrical cam and the eraser delivering mechanism of the variational example are different from those of the embodiment described heretofore, description will be made on these different parts while the other identical parts are allotted with the same reference numerals and the description of these parts will not be repeated.

Differences of a rear barrel 11A from the rear barrel 11 reside in that a screw groove 31A to be engaged with the partial-screw projections 35 of the eraser holder 29 is formed on the hollowed inside of the rear barrel 11A and that a cam portion 13*a*A corresponding to the cam portion 13*a* of the cylindrical cam 13 is integrally formed with the rear barrel 11A.

A difference of an eraser delivering mechanism 17A from the corresponding part, namely the eraser delivering mechanism 17 lies in the feature of the crown. Specifically, a crown 27A in the variational example 1A comprises an externally fitted portion $27A_1$ on the rear barrel 11A and an internally fitted portion $27A_2$ inside the rear barrel 11A and is rotatably attached to the rear barrel 11A. The internally fitted portion $27A_2$ is formed with a of slits $13b_2A$, $13b_2A$ corresponding to the slits $13b_2$, $13b_2$ of the cylindrical cam 13.

Therefore, when the eraser delivering mechanism 17 in the variational example 1A is operated, the crown 27A is rotated by holding the externally fitted portion $27A_1$ of the crown fitted on the rear barrel 11A. This rotational force causes the eraser holder 29 to rise up or move down inside the crown 27A, as guided by the slits $13b_2A$, $13b_2A$, since the eraser holder 29 has the partial screw-projections 35 engaged with the screw groove 31A of the rear barrel 11A with the pair slits $13b_2A$, $13b_2A$ formed in the internally fitted-portion $27A_2$ of the rear barrel 11A being placed therebetween.

Here, the rear barrel 11A and cam portion 13*a*A are integrally formed, so that they can be assumed, in practice, as one component of the writing implement 1A. Therefore, the rear portion 11A together with the cam portion 13*a*A may be considered as a cylindrical cam.

Figure 31:
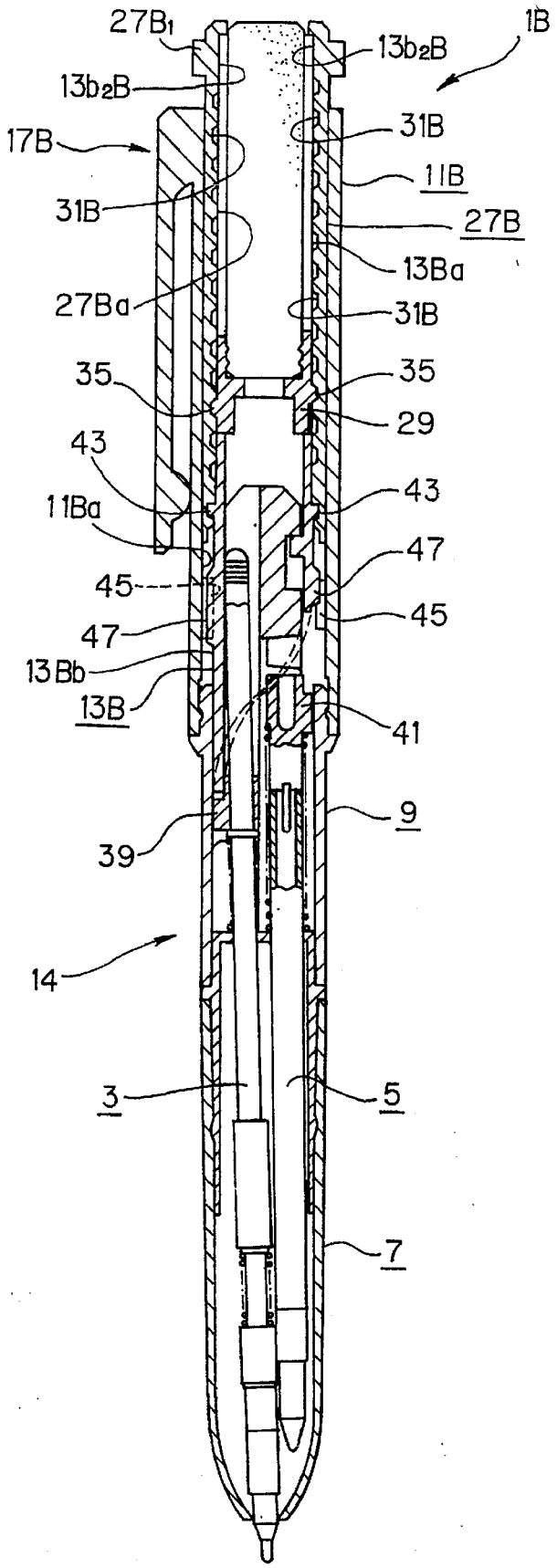
FIG. 31 is a longitudinal sectional view showing a second variational example of a multiplex writing implement in accordance with the present invention.

FIG. 31 shows a second variational example 1B of a writing implement 1. Since, also in this variational example 1B, only the rear barrel, the cylindrical cam and the eraser delivering mechanism are different, description will be made on these different parts while the other identical parts are allotted with the same reference numerals and the description of these parts will not be repeated.

A rear barrel 11B is rotatable but is not able to move in the axial direction. An inside peripheral surface 11Ba of the rear barrel 11B is formed with inner peripheral projections 45, 45 which engage after-mentioned outside peripheral projections 47, 47 on a cylindrical cam 13B in order to rotate the cylindrical cam 13B in accordance with the rotation of the rear barrel 11B.

The cylindrical cam 13B is fitted inside the rear barrel 11B with a clearance kept therebetween and has a pair of slits $13b_2B$, $13b_2B$ formed in a rear-half portion 13B*a* thereof. Further, a front-half portion 13B*b* of the cylindrical cam 13B has outside peripheral projections 47, 47 formed at appropriate intervals on the outside peripheral surface thereof.

A crown 27B as a part of an eraser delivering mechanism 17B is internally fitted between the rear barrel 11B and the cylindrical cam 13B, rotatably and slidably in the axial direction. An inside peripheral surface 27B*a* of the crown is,formed with a screw groove 31B. Further, the crown 27B is integrally engaged with the cylindrical cam 13B by way of an engaging means 43. Here, reference numeral $27B_1$ designates the projected portion of the crown 27B which projects from the rear end of the rear barrel 11B.

Therefore, when the eraser delivering mechanism 17B in the variational example 1B is operated, the crown 27B is rotated by holding the projected portion $27B_1$ of the crown 27B. This rotational force causes the eraser holder 29 to rise up or move down inside the crown 27B, as guided by the slits $13b_2B$, $13b_2B$ of the cylindrical cam 13B, since the eraser holder 29 has the partial screw-projections 35 engaged with the screw groove 31B of the crown 27B with the pair slits $13b_2B$, $13b_2B$ of the cylindrical cam 13B being placed therebetween. When the writing implement 1B is used as a mechanical pencil, the crown 27B functions as a knocking portion. In this case, only the crown 27B moves axially inside the rear barrel 11B since the rear barrel 11B is unable to move in the axial direction as stated above.

As the rear barrel 11*b* is rotated, the inside peripheral projections 45, 45 of the rear barrel engage the outside peripheral projections 47, 47 of the cylindrical cam 13B. A further rotation of the rear barrel 11B causes the cylindrical cam 13B to rotate to thereby project a desired refill 3 or 5 from the front end of the front barrel 7.

In the description heretofore, the embodiments of the writing implement having two refills have been described, but the writing implement of the present invention may include three or more refills. Further, it is needless to mention that the stick-shaped eraser can be replaced by any other stick-shaped article such as, for example, a colored pencil lead, a correcting rod etc.

What is claimed is:

1. A multiplex writing implement having a longitudinal axis defining an axial direction, said writing implement comprising:

a plurality of writing elements of different types each having a tip portion and rearwardly extending remaining parts;

a writing element selecting mechanism for selecting, as desired, one writing element from said plurality of writing elements; and a delivering mechanism which delivers a stick-shaped article;

wherein said writing element selecting mechanism comprises:

a front barrel having a front portion accommodating at least each of said tip portions of said writing elements therein, and a rear portion;

a middle barrel integrally joined to said rear portion of said front barrel such that said front barrel and said middle barrel are prevented from rotating and falling off relative to each other, said middle barrel accommodating the remaining parts of said writing elements and further including a rear portion;

a rear barrel disposed on said rear portion of said middle barrel, said rear barrel being rotatable clockwise or counterclockwise relative to said middle barrel and fixed in the axial direction, said rear barrel defining a hollowed space therein and an inner peripheral projection extending inwardly within said rear barrel; and a single-piece cylindrical cam fitted inside said hollowed space of said rear barrel and spaced from said inside wall of said rear barrel, said cylindrical cam having an outside peripheral projection and a rear portion having a pair of slits extending in the axial direction, said cylindrical cam being slidable in the axial direction and rotatable upon engaging said outside peripheral projection with said inner peripheral projection of said rear barrel and rotating said rear barrel whereupon said cylindrical cam pushes forward one of said writing elements so as to project the tip portion of said one of said writing elements from said front portion of said front barrel and retracts the tip portion of the other writing element inside said front barrel; and wherein said delivering mechanism for delivering a stick-shaped article comprises:

a crown rotatably fitted between said rear barrel and said cylindrical cam, said crown having an inside peripheral surface with a screw groove formed therein, said crown being integrally engaged with said cylindrical cam and serving as a knocking member for at least one of said writing elements; and a single-piece stick-shaped article holder accommodated in said crown and in said rear portion of said cylindrical cam, said article holder having screw-projections extending through said slits of said rear portion of said cylindrical cam and engaging with said screw groove of said crown so that said stick-shaped article holder is advanced upon rotation of said crown, with said screw-projections being guided by said slits.

* * * * *